US008809248B2

(12) United States Patent
Huo et al.

(10) Patent No.: US 8,809,248 B2
(45) Date of Patent: Aug. 19, 2014

(54) ENGINE CLEANING COMPOSITION AND METHOD FOR CLEANING THE ENGINE

(75) Inventors: Xin Huo, Shanghai (CN); Jeffrey R. Janssen, Woodbury, MN (US); Hung Che Cheng, Taiwan (CN)

(73) Assignee: 3M Innovative Properties Company, Saint Paul, MN (US)

( * ) Notice: Subject to any disclaimer, the term of this patent is extended or adjusted under 35 U.S.C. 154(b) by 84 days.

(21) Appl. No.: 13/321,958

(22) PCT Filed: May 26, 2010

(86) PCT No.: PCT/US2010/036166
§ 371 (c)(1), (2), (4) Date: Nov. 22, 2011

(87) PCT Pub. No.: WO2010/141283
PCT Pub. Date: Dec. 9, 2010

(65) Prior Publication Data

US 2012/0071377 A1 Mar. 22, 2012

(30) Foreign Application Priority Data

Jun. 1, 2009 (CN) ..... 2009 1 0145289

(51) Int. Cl.

| | |
|---|---|
| ***C11D 3/30*** | (2006.01) |
| ***C11D 11/00*** | (2006.01) |
| ***C11D 1/10*** | (2006.01) |
| ***C11D 3/20*** | (2006.01) |
| ***C11D 7/26*** | (2006.01) |
| ***C11D 7/32*** | (2006.01) |
| ***F02B 77/04*** | (2006.01) |

(52) U.S. Cl.
CPC ..... *C11D 11/0041* (2013.01); *C11D 1/10* (2013.01); *C11D 3/2086* (2013.01); *C11D 3/30* (2013.01); *C11D 7/265* (2013.01); *C11D 7/3218* (2013.01); *F02B 77/04* (2013.01)
USPC ..... 510/185; 510/499

(58) Field of Classification Search
CPC ..... C11D 3/30; C11D 11/0041
USPC ..... 510/185
See application file for complete search history.

(56) References Cited

U.S. PATENT DOCUMENTS

| | | | | |
|---|---|---|---|---|
| 2,952,637 | A | 9/1960 | Bray | |
| 3,876,704 | A | 4/1975 | Nakaguchi | |
| 4,055,402 | A | 10/1977 | Battersby | |
| 4,435,303 | A | 3/1984 | Abadi | |
| 4,539,233 | A | 9/1985 | Melotik | |
| 4,797,220 | A | 1/1989 | Miller | |
| 5,407,453 | A | 4/1995 | Pierce-Ruhland | |
| 6,156,129 | A * | 12/2000 | Hlivka et al. | 134/42 |

FOREIGN PATENT DOCUMENTS

| | | |
|---|---|---|
| CN | 1153813 | 7/1997 |
| JP | 10237417 | 9/1998 |
| WO | 91/05742 | 5/1991 |

OTHER PUBLICATIONS

PCT International Search Report for PCT/US2010/036166, mailed Aug. 30, 2010.

* cited by examiner

*Primary Examiner* — Gregory Webb
(74) *Attorney, Agent, or Firm* — Aleksander Medved

(57) ABSTRACT

The present invention provides a method of cleaning an engine having at least one combustion chamber, and the method includes the steps of providing an engine cleaning composition and introducing the cleaning composition into the combustion chamber. The engine cleaning composition includes: (i) 10-100 wt % of an alkanol amine hydroxy carboxylate represented by formula (I): $RCHOHCOONH_{a+1}((CH2)_nOH)_b$ (I), wherein n is an integer in the range of 1 to 10; a is 0, 1 or 2; b is 1, 2 or 3; such that a+b=3; R represents hydrogen atom or alkyl; (ii) 0-90 wt % of a surfactant; (iii) 0-90 wt % of a solvent; and (iv) 0-90 wt % of water. The present invention also provides an engine cleaning composition to remove carbon deposit from engines.

30 Claims, No Drawings

ENGINE CLEANING COMPOSITION AND METHOD FOR CLEANING THE ENGINE

CROSS REFERENCE TO RELATED APPLICATIONS

This application is a national stage filing under 35 U.S.C. 371 of PCT/US2010/036166, filed May 26, 2010, which claims priority to Chinese Application No. 200910145289.5, filed Jun. 1, 2009, the disclosure of which is incorporated by reference in its/their entirety herein.

FIELD OF THE INVENTION

The present invention relates to compositions used for removing carbon deposit from engines and methods for cleaning the same.

BACKGROUND

Automobile users have been bothered by troublesome contamination of engines, especially the carbon deposits produced in the engines during the work process. It has been found that the fuel induction system, inlet valves, and combustion chambers of internal combustion engines are subject to carbon deposits which are formed under high temperature and derived from many sources, including materials in the fuel, products of fuel decomposition, products of fuel combustion, contaminants in the air which are not removed by filtration, and lubricating oil residues. The carbon deposits cause uneven distribution of the fuel charge in the cylinder of the engine, insufficient quantities of fuel supply in the various cylinders, and other problems which lead to poor engine performance, increased emissions, and poor fuel economy.

U.S. Pat. No. 3,876,704 discloses that N-long chain alkyl, N-hydroxyalkyl alkylenepolyamines are useful as detergents in hydrocarbon fuels.

U.S. Pat. No. 4,055,402 discloses that polyisobutenyl aminoethylethanolamine is useful as a gasoline detergent at levels from 50 to 200 parts per million.

CN1153813A discloses a cleaner consists of ethanolamine, butyl alcohol, ethyl ether, ammonia water, oleic acid, emulsifier, engine oil and kerosine, and it is used for cleaning stain and carbon deposit in internal combustion engines.

U.S. Pat. No. 5,407,453A1 discloses a composition comprising an alkoxy alcohol, an aliphatic alcohol, a liquid petroleum distillate, a liquid fatty acid, a volatile nitrogen base, polyisobuteny aminoethylethanolamine, and water may be used as an engine deposit cleaner which removers air and fuel induction system deposits, valve deposits, and combustion chamber deposits.

However, the use of aromatic hydrocarbon solvent, or glycol ether, or alkali may have environment concerns. Moreover, the cleaning efficiency of a typical detergent composition is not satisfactory to clean the engines which are contaminated by carbon deposits.

Accordingly, it is an object of this invention to provide cleaning compositions which can remove carbon deposits not only from fuel induction system but also from the inlet valves and combustion chambers of engines without above mentioned disadvantages. Instead of being used in the fuel itself, the cleaning compositions of the present invention are intended to be used as a single cleaning treatment of the engines.

SUMMARY OF THE INVENTION

In one aspect, the present invention provides a method of cleaning an engine having at least one combustion chamber, the method comprising:

(a) providing a composition comprising:

(i) 10-100 wt % of an alkanol amine hydroxy carboxylate represented by formula (I):

$$RCHOHCOONH_{a+1}(CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 0-90 wt % of a surfactant;

(iii) 0-90 wt % of a solvent; and (iv) 0-90 wt % of water;

(b) introducing the composition into the combustion chamber.

In another aspect, the present invention provides a method for cleaning an engine comprising the steps of: (a) providing a composition produced by mixing the following ingredients: 7-70% of hydroxy acid by weight of the cleaning composition; 3-50% of at least one alkanol amine by weight of the cleaning composition provided that the total weight percent of hydroxy acid and the at least one alkanol amine is 10-100% by weight of the cleaning composition; 0-90% of surfactant by weight of the cleaning composition; 0-90% of solvent by weight of the cleaning composition; 0-90 wt % of water; and (b) providing the composition to be in contact with the engine for a predetermined period of time.

In still another aspect, the present invention provides an engine cleaning composition, comprising:

(i) 10-100 wt % of an alkanol amine hydroxy carboxylate represented by formula (I):

$$RCHOHCOONH_{a+1}(CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 0-90 wt % of a surfactant;

(iii) 0-90 wt % of a solvent; and (iv) 0-90 wt % of balanced water;

The above summary of the present invention is not intended to describe each disclosed embodiment or every implementation of the present invention. The detailed description which follow more particularly exemplify illustrative embodiments.

DETAILED DESCRIPTION OF THE INVENTION

The present invention provides a method of cleaning an engine having at least one combustion chamber, and the method includes the steps of providing an engine cleaning composition and introducing the cleaning composition into the combustion chamber. The engine cleaning composition includes:

(i) 10-100 wt % of an alkanol amine hydroxy carboxylate represented by formula (I):

$$RCHOHCOONH_{a+1}(CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 0-90 wt % of a surfactant;

(iii) 0-90 wt % of a solvent; and (iv) 0-90 wt % of balanced water;

The compositions may be used as an engine deposit cleaner which removes air and fuel induction system deposits, inlet valve deposits, and combustion chamber deposits. It can understood that the composition represented by above mentioned formula may have other structures, such as, straight or branched chain structure with the same functional group. It can also be understood that the surfactant, solvent, and water can be optionally present in the composition. In another exemplary embodiment, the alkanol amine hydroxy carboxylate is produced by means of hydroxy acid reacting with at least one alkanol amine, optionally in water and/or solvent.

In another exemplary embodiment, the cleaning composition comprises 30-70 wt % of the alkanol amine hydroxy carboxylate, and 30-70 wt % of the surfactant.

In another exemplary embodiment, the cleaning composition comprises 30-70 wt % of an alkanol amine hydroxy carboxylate, and 30-70 wt % of a solvent.

In another exemplary embodiment, the cleaning composition comprises 30-70 wt % of an alkanol amine hydroxy carboxylate, 10-60 wt % of a surfactant, 10-60 wt % of a solvent, and 0-90 wt % water.

In another exemplary embodiment, the present invention provides a method for cleaning an engine comprising the steps of: (a) providing a composition produced by mixing the following ingredients: 7-70% of hydroxy acid by weight of the cleaning composition; 3-50% of at least one alkanol amine by weight of the cleaning composition provided that the total weight percent of hydroxy acid and the at least one alkanol amine is 10-100% by weight of the cleaning composition; 0-90% of surfactant by weight of the cleaning composition; 0-90% of solvent by weight of the cleaning composition; 0-90 wt % of water; and (b) providing the composition to be in contact with the engine for a predetermined period of time.

In another exemplary embodiment, hydroxy acid and the at least one alkanol amine are reacted with each other to form an alkanol amine hydroxy carboxylate. It can be understood by an ordinary person skilled in the art that homologous analog to hydroxy acid may be reacted with homologous analog to alkanol amine under a certain circumstance, in addition to exemplary embodiments illustrated in the presentation application.

In another exemplary embodiment, hydroxy acid and the at least one alkanol amine are equimolar.

In another exemplary embodiment, hydroxy acid and the at least one alkanol amine are mixed to form an alkanol amine hydroxy carboxylate before mixing with other ingredients.

In another exemplary embodiment, hydroxy acid, the at least one alkanol amine, and water are mixed to form an alkanol amine hydroxy carboxylate before mixing with other ingredients.

Alkanol Amine Hydroxy Carboxylate

The alkanol amine hydroxy carboxylate is a necessary ingredient of the cleaning composition according to the present invention. The alkanol amine hydroxy carboxylate used in the present invention are produced by reacting a hydroxy acid with at least one alkanol amine.

The alkanol amines used in the present invention include but not limited to monoethanolamine, diethanolamine and triethanolamine. The alkanol amines are compounds of the general formula (II):

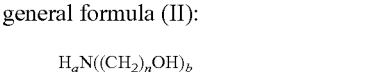

$$H_aN((CH_2)_nOH)_b \quad (II)$$

wherein n is an integer in the range of 1 to 10, in some exemplary embodiments n ranges from 1 to 5, or in some exemplary embodiment n ranges from 1 to 2; a is 0, 1 or 2; b is 1, 2 or 3; such that a+b=3.

The hydroxy acids suitable for the present invention may include but not limited to lactic acid and hydroxyacetic acid. The hydroxy acids are compounds of the general formula (III):

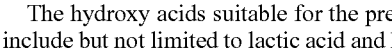

$$RCHOHCOOH \quad (III)$$

wherein R represents hydrogen atom or the alkyl. In one exemplary embodiment, the alkyl has generally 1 to 8 carbon atoms. In a specifically exemplary embodiment, the alkyl has 1 to 3 carbon atoms. In a more specifically exemplary embodiment, the alkyl has 1 carbon atom.

Preferably, hydroxy acid and the at least one alkanol amine used for preparing the alkanol amine hydroxy carboxylate are equimolar, although it is acceptable to use hydroxy acid or the at least one alkanol amine in excess. According to some exemplary embodiments, the hydroxy acid constitutes at least 50 wt % of the total weight of hydroxy acid and the at least one alkanol amine.

According to some exemplary embodiments of the present invention, the alkanol amine hydroxy carboxylate alone or in the form of an aqueous solution can be used to remove the carbon deposit. In the case of the alkanol amine hydroxy carboxylate alone is used, the moiety derived from hydroxy acid preferably constitutes at least 50 wt % by weight of the alkanol amine hydroxy carboxylate. When the alkanol amine hydroxy carboxylate aqueous solution is used, the water constitutes no more than 90 wt %, preferably no more than 70 wt % of the composition.

Surfactant

The surfactant is not a necessary ingredient for the cleaning composition according to the present invention. However, a wide variety of surfactants may be used in the present invention. If used, the surfactant may constitute no more than 90 wt % of the cleaning composition. The surfactants used in the present invention include but not limited to, nonionic surfactants, anionic surfactants, cationic surfactants and some Glycol ether. Nonionic surfactants include alkoxylated nonionic surfactants. Alkoxylated nonionic surfactant materials can be broadly defined as compounds produced by the condensation of alkylene oxide groups with an organic hydrophobic compound, which may be aliphatic or alkyl aromatic in nature. The length of the polyoxylakylene group which is condensed with any particular hydrophobic group can be readily adjusted to yield a water-soluble compound having the desired degree of balance between hydrophilic and hydrophobic elements. The polyethylene oxide condensates of alkyl phenol, e.g. the condensation products of alkyl phenols having an alkyl group containing from 6-12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerised propylene, diisobutylene, octane and nonene. Other examples include dodecylphenol condensed with 12 moles of ethylene oxide per mole of phenol; dinonylphenol condensed with 15 moles of ethylene oxide per mole of phenol; nonylphenol and di-iso-isooctylphenol condensed with 15 moles of ethylene oxide. In an exemplary embodiment, suitable anionic surfactant is alkyl benzene sulfonates. In another exemplary embodiment, suitable cationic surfactant is alkyl dimethyl hydroxy ethyl ammonium chloride. In another exemplary embodiment, surfactant is fatty alcohol ethoxylated dodecyl, for example AEO7 available from Sasol (alcohol C12-C14, poly (7) ethoxylate). Preferably, two or more surfactants are used together in the cleaning composition according to the instant invention. The two or more surfactants can be added into the system respectively or in the form of mixture thereof. The most preferred surfactant mixture comprises a fatty alcohol ethoxylated dodecyl and at least one surfactant selected from a group consisting of benzenesulfonic acid, propylene glycol Monomethyl ether (DPM), and alkyl dimethyl hydroxy ethyl ammonium chloride (Pragpagen HY).

Solvent

The solvent is not a necessary ingredient for the cleaning composition according to the present invention. However, a wide variety of solvents may be used in the present invention. If used, the solvent may constitute no more than 90 wt % of the cleaning composition. The type of hydrocarbon useful in the invention may be selected from a broad class of aliphatic solvents. Preferred hydrocarbon compounds or blends thereof are not classified as flammable liquids (Flash point at or above 100 F by tag closed cup method) and they have solubility parameter ranges for, nonpolar of 6.5 to 10.5, for polar of 0 to 2.5 and hydrocarbon bonding of 0 to 2.5 based on the three dimensional Hansen Solubility Parameter System with units of the square root of calories per cubic centimeter. More preferred are the above hydrocarbon compounds or blends thereof with flash points above 140 F and preferably above 200 F. Particularly preferred are aliphatic hydrocarbon liquids wherein the aliphatic hydrocarbon liquid consists of cycloparaffins, isoparaffins, n-paraffins or mixtures thereof. Examples of such hydrocarbon components are the high flash point mineral spirits and naphthas readily available from a variety of suppliers. Specific examples are Exxon "Isopar", Essol "D60" and Shell "Soltrol" solvents.

Water

Water is not a necessary ingredient for the cleaning composition according to the present invention. If used, water may constitute no more than 90 wt %, preferably no more than 70 wt % of the cleaning composition. In this case, the cleaning composition is an aqueous solution in which the alkanol amine hydroxy carboxylate exists in the solution in form of an ion.

PH of the Compositions

The PH value of the cleaning composition according to the present invention may range from 5 to 9 and can be regulated according to conventional methods, for example, by adding additional base such as NaOH or KOH.

Methods of Mixing the Compositions

In producing these compositions, the ingredients may be combined in several ways.

According to some embodiments, the alkanol amine hydroxy carboxylate may be prepared by mixing hydroxy acid, at least one alkanol amine and optional water and/or solvent and/or surfactant mixture. Preferably, the hydroxy acid and the at least one alkanol amine are equimolar. The obtained alkanol amine hydroxy carboxylate can be either directly used as the cleaning composition according to the present invention or used for further mixing with other ingredients. In one exemplary embodiment, hydroxy acid and the alkanol amine are introduced into a container and mixed to form an alkanol amine hydroxy carboxylate. Then, surfactant and solvent can be added into the mixture of hydroxy acid and the alkanol amine sequentially or simultaneously. If necessary, a balanced amount of water can be introduced into the container to form a final cleaning composition. In other exemplary embodiment, hydroxy acid, the at least one alkanol amine, and water are mixed to form an alkanol amine hydroxy carboxylate. Then, solvent and surfactant can be added into the mixture simultaneously or sequentially.

It is understandable that all the ingredients can be added into the reactor simultaneously or sequentially, wherein hydroxy acid and the at least one alkanol amine react with each other to form the alkanol amine hydroxy carboxylate.

Use of the Compositions

The cleaning compositions of the present invention are intended for use in a procedure for cleaning an engine, for example, an internal-combustion engine of a car. The procedure includes following steps. When the engine needs to be cleaned, spark plug of the engine will be removed first. Then, the prepared cleaning composition is introduced into combustion chambers of the engine via a conduit with a suitable diameter. For instance, 120-150 ml prepared cleaning composition can be distributed into each combustion chamber. Then, the engine is kept still for a period of time in order to have a better cleaning effect by ensuring the composition to sufficiently soak the carbon deposit in the combustion chamber. After that period of time, for example 60 minutes, the used or reacted cleaning composition can be sucked out via the conduit from the combustion chamber. Finally, the chambers are dried via a traditional means.

This invention provides a high performance cleaning composition without aromatic hydrocarbon and ethylene glycol ether. As can be seen from the following examples, all the cleaning compositions according to the present invention provides a cleaning rate higher than 50% and a good or very good cleaning performance. Some particularly preferred embodiments even provided very satisfactory cleaning performance.

EXAMPLES

These examples are merely for illustrative purposes only and are not meant to be limiting on the scope of the appended claims. All parts, percentages, ratios, etc. in the examples and the rest of the specification are by weight, unless noted otherwise.

Table of Abbreviations

| Abbreviation or Trade Designation | Name | Supplier | CAS No |
|---|---|---|---|
| AEO 7 | Alcohol C12-C14, poly (7) ethoxylate | Sasol | 68439-50-9 |
| D 60 | Alkyl hydrocarbon solvent | Qing Yuan Xing Chemical | 64742-48-9 |
| DPM | Propylene Glycol Monomethyl Ether | DOW | 34590-94-8 |
| LASH | Dodecyl benzenesulfonic acid | Jing Di Chemical | 27176-87-0 |
| HY | alkyl dimethyl hydroxy ethyl ammonium chloride | Clairiant | — |
| LA | Lactic acid | PURAC | 79-33-4 |
| MEA | Monoethanolamine | DOW | 121-43-5 |
| HA | Hydroxyacetic acid | Haiqu Chemical | 79-14-1 |
| NaOH | Sodium hydroxide | Sinopharm Chemical | 1310-73-2 |
| 9543 | POWERZOL 9543, a kind of polyether amine | Lubrizol | — |
| AP | Aluminum Panel | Xuwan Trading Co. | — |
| H2O | DI water | — | 7732-18-5 |
| A | Surfactant | — | — |
| B | Solvent | — | — |
| C | Alkanol amine hydroxy carboxylate | — | — |

Test Method

AP Dipping Cleaning Test Method was used to test the cleaning performance of the compositions prepared in the examples and comparative examples.

This test is to evaluate cleaning performance of different formula by removing artificial carbon deposit on aluminum panel sample in 60 minutes ("min" hereinafter).

1. Aluminum panel sample preparation. three sample aluminum panels were prepared and the weight of each panel was recorded as ml;

2. Gasoline and Lubricant preparation. 200 g gasoline and 60 g mixture of gasoline and lubricant (50% gasoline and 50% lubricant) were prepared, respectively. The gasoline is 93# gasoline available from China market and lubricant is Castrol GTX 10W-40.

3. Burning. First each aluminum panel is put into an iron can. Then, 60 g gasoline and lubricant mixture were poured into the can and got burnt. When the gasoline and lubricant mixture burnt out, another 200 g gasoline was added into the can and continued burning.

4. Recording. After the burnout, the weight of the aluminum panel was recorded as m2.

5. Cleaning. The aluminum panel sample was dipped into a 200 ml beaker full of test liquid for 60 min in 80. After that, the aluminum panel was wiped with rag and dried it for 2 hours, and then the weight of the aluminum panel was recorded as m3.

6. Calculating. The cleaning rate can be calculated as following formula:

$$\text{Cleaning Rate}=(m2-m3)/(m2-m1)100\%$$

7. Evaluation for cleaning performance.

| Cleaning class | Cleaning Rate/% |
|---|---|
| Very Good | ≥75 |
| Good | 50~75 |
| Normal | 25~50 |
| Bad | ≤25 |

The formula whose cleaning class is good or very good is deemed as a high cleaning performance formula.

The liquid cleaning compositions of Example 1-4 were prepared as follows:

Example 1

210 g lactic acid into reactor and 700 g DI water were introduced into a reactor. And then the introduced lactic acid and DI water were agitated for 20 minutes ("min" hefereinafter) to form a transparent and stable liquid mixture. After that, 90 g monoethanolamine was introduced into the mixture slowly and agitated for 120 min to produce a transparent and stable liquid.

Example 2

350 g lactic acid and 500 g DI water were introduced into a reactor. And then the introduced lactic acid and DI water were agitated for 20 min to form a transparent and stable liquid mixture. After that, 150 g monoethanolamine was introduced into the mixture slowly and then was agitated for 120 min to form a transparent and stable liquid.

Example 3

490 g lactic acid into reactor and 300 g DI water were introduced into a reactor. And then the introduced lactic acid and DI water were agitated for 20 min to form a transparent and stable liquid mixture. After that, 210 g monoethanolamine was added into the mixture slowly and then the final mixture was agitated for 120 min to form a transparent and stable liquid.

Example 4

700 g lactic acid was introduced into a reactor. After that, 300 g monoethanolamine was introduced into the reactor slowly and then was agitated for 120 min to form a transparent and stable liquid.

Each of these compositions was tested using the AP Test Method described above. The data are presented in Table 1.

TABLE 1

| Example | LA | MEA | DI Water | pH | Cleaning Rate/% | Cleaning class |
|---|---|---|---|---|---|---|
| 1 | 21 | 9 | 70 | 8 | 51.8 | Good |
| 2 | 35 | 15 | 50 | 8 | 56.8 | Good |
| 3 | 49 | 21 | 30 | 8 | 62.6 | Good |
| 4 | 70 | 30 | 0 | 8 | 72.4 | Good |

The ingredients for preparing the liquid cleaning compositions of Examples 5-17 are described as follows.

Part A: Surfactant. The composition of the surfactant is shown in Table 2.

TABLE 2

| Ingredient | Content/% |
|---|---|
| AEO7 | 100 |

Part B: Solvent. The composition of the solvent is shown in Table 3

TABLE 3

| Ingredient | Content/% |
|---|---|
| D 60 | 100 |

Part C: Alkanol amine hydroxy carboxylate. The composition of alkanol amine hydroxy carboxylate is formed by mixing the lactic acid with MEA is shown in Table 4

TABLE 4

| Ingredient | Content/% |
|---|---|
| LA | 70 |
| MEA | 30 |

The liquid cleaning compositions of Examples 5-17 were prepared as follows.

Example 5

70 g lactic acid was introduced into a reactor. And then 30 g monoethanolamine was introduced into the reactor slowly and then was agitated for 120 min to form a transparent and stable liquid. After that, 900 g D60 solvent was introduced into the mixture and was agitated for 30 min to form a transparent and stable liquid.

Example 6

70 g lactic acid was introduced into a reactor. And then 30 g monoethanolamine was introduced into the reactor slowly and then was agitated for 120 min to form a transparent and stable liquid mixture. After that, 900 g AEO7 surfactant was added into the mixture and then was agitated for 30 min to form a transparent and stable liquid.

Example 7

140 g lactic acid was introduced into a reactor. And then 60 g monoethanolamine was introduced into the reactor slowly and then was agitated for 120 min to form a transparent and stable liquid mixture. After that, 800 g D60 solvent was added into the mixture and was agitated for 30 min to form a transparent and stable liquid.

Example 8

140 g lactic acid was introduced into a reactor. And then 60 g monoethanolamine was introduced into the reactor slowly and then was agitated for 120 min to form a transparent and stable liquid mixture. After that, 800 g AEO7 surfactant was added into the mixture and then was agitated for 30 min to form a transparent and stable liquid.

Example 9

210 g lactic acid was introduced into a reactor. And then 90 g monoethanolamine was introduced into the reactor slowly and then was agitated for 120 min to form a transparent and stable liquid mixture. After that, 600 g D60 solvent and 100 g AEO7 surfactant were added into the mixture. Finally, the mixture in the reactor was agitated for 30 min to form a transparent and stable liquid.

Example 10

210 g lactic acid was introduced into a reactor. And next 90 g monoethanolamine was introduced into the reactor slowly and then was agitated for 120 min to form a transparent and stable liquid mixture. After that, 350 g AEO7 surfactant and 350 g D60 solvent were added into the mixture and then was agitated for 30 min to form a transparent and stable liquid.

Example 11

210 g lactic acid was introduced into a reactor. Next, 90 g monoethanolamine was introduced into the reactor slowly and then was agitated for 120 min to form a transparent and stable liquid mixture. After that, 600 g AEO7 surfactant and 100 g D60 were added into the mixture and then the final mixture was agitated for 30 min to form a transparent and stable liquid.

Example 12

350 g lactic acid was introduced into a reactor. Next, 150 g monoethanolamine was introduced into the reactor slowly and then was agitated for 120 min to produce a transparent and stable liquid mixture. After that, 100 g AEO7 surfactant and 400 g D60 solvent were added into the mixture and then was agitated for 30 min to form a transparent and stable liquid.

Example 13

350 g lactic acid was introduced into a reactor. Next, 150 g monoethanolamine was introduced into the reactor slowly and then was agitated for 120 min to form a transparent and stable liquid mixture. After that, 250 g AEO7 surfactant and 250 g D60 solvent were added into the mixture and then was agitated for 30 min to form a transparent and stable liquid.

Example 14

350 g lactic acid was introduced into a reactor. Next, 150 g monoethanolamine was introduced into the reactor slowly and then was agitated for 120 min to form a transparent and stable liquid mixture. After that, 400 g AEO7 surfactant and 100 g D60 solvent were added into the mixture and then was agitated for 30 min to form a transparent and stable liquid.

Example 15

490 g lactic acid was introduced into a reactor. Next, 210 g monoethanolamine was introduced into the reactor slowly and then was agitated for 120 min to form a transparent and stable liquid mixture. After that, add 100 g AEO7 surfactant and 200 g D60 solvent were introduced into the mixture and then was agitated for 30 min to form a transparent and stable liquid.

Example 16

490 g lactic acid was introduced into a reactor. Next, 210 g monoethanolamine was introduced into the reactor slowly and then was agitated for 120 min to form a transparent and stable liquid mixture. After that, 150 g AEO7 surfactant and 150 g D60 solvent were added into the mixture and then was agitated for 30 min to form a transparent and stable liquid.

Example 17

490 g lactic acid was introduced into a reactor. Next, 210 g monoethanolamine was introduced into the reactor slowly and then was agitated for 120 min to form a transparent and stable liquid mixture. After that, 200 g AEO7 surfactant and 100 g D60 solvent were added into the mixture and then was agitated for 30 min to form a transparent and stable liquid.

Each of these compositions was tested using the AP Dipping Cleaning Test Method described above. The data are presented in Table 5.

TABLE 5

| Example | A | B | C | pH | Cleaning Rate/% | Cleaning class |
|---|---|---|---|---|---|---|
| 5 | 0 | 90 | 10 | 8 | 67.7 | Good |
| 6 | 90 | 0 | 10 | 8 | 64.8 | Good |
| 7 | 0 | 80 | 20 | 8 | 72.3 | Good |
| 8 | 80 | 0 | 20 | 8 | 68.9 | Good |
| 9 | 10 | 60 | 30 | 8 | 89.3 | Very Good |
| 10 | 35 | 35 | 30 | 8 | 92.3 | Very Good |
| 11 | 60 | 10 | 30 | 8 | 86.3 | Very Good |
| 12 | 10 | 40 | 50 | 8 | 90.6 | Very Good |
| 13 | 25 | 25 | 50 | 8 | 93.2 | Very Good |
| 14 | 40 | 10 | 50 | 8 | 89.7 | Very Good |
| 15 | 10 | 20 | 70 | 8 | 89.3 | Very Good |
| 16 | 15 | 15 | 70 | 8 | 90.5 | Very Good |
| 17 | 20 | 10 | 70 | 8 | 88.5 | Very Good |

Comparison Between Example 4, 18, 19, 20 and C1

Example 4 shows a liquid cleaning composition according to the present invention described in Table 1.

Example 18

600 g lactic acid was introduced into a reactor. Next, 400 g diethanolamine was introduced into the reactor slowly and then was agitated for 120 min to form a transparent and stable liquid.

Example 19

500 g lactic acid was introduced into a reactor. Next, 500 g triethanolamine was introduced into the reactor slowly and then was agitated for 120 min to form a transparent and stable liquid.

Example 20

500 g hydroxyacetic acid was introduced into a reactor. Next, 500 g monoethanolamine was introduced into the reactor slowly and then was agitated for 120 min to form a transparent and stable liquid.

Comparative example 1(C1) shows a liquid cleaning composition which is the mixture of Oleic acid and MEA.

Comparative example 2(C2) shows a liquid cleaning composition which is the mixture of Citric acid and MEA.

Each of these compositions was tested using the AP Dipping Cleaning Test Method. The data are presented in Table 6.

TABLE 6

| Example | LA | HA | Oleic Acid | Citric acid | TEA | DEA | MEA | pH | DI Water | Cleaning Rate/% | Cleaning class |
|---|---|---|---|---|---|---|---|---|---|---|---|
| 4 | 70 | | | | | | 30 | 8 | 0 | 72.4 | Good |
| 18 | 60 | | | | | 40 | | 7 | 0 | 66.1 | Good |
| 19 | 50 | | | | 50 | | | 7 | 0 | 64.8 | Good |
| 20 | | 50 | | | | | 50 | 8 | 0 | 74.3 | Good |
| C1 | | | 50 | | | | 50 | 7 | 0 | 22.5 | Bad |
| C2 | | | | 50 | | | 50 | 8 | 0 | 18.8 | Bad |

Comparison Between Example 10, C3, C4 and C5

Example 10 is a liquid cleaning composition described in Table 5.

Comparative example 3 (C3) is a cleaning composition which is full of B.

Comparative example 4 (C4) is a cleaning composition which is the mixture of A and B Comparative example 5 (C5) is a cleaning composition which is full of A.

Each of these compositions was tested using the AP Cleaning Test Method. The data are presented in Table 7

TABLE 7

| Example | A | B | C | Cleaning Rate/% | Cleaning class |
|---|---|---|---|---|---|
| 10 | 35 | 35 | 30 | 92.3 | Very Good |
| C3 | 0 | 100 | 0 | 47.6 | Normal |
| C4 | 50 | 50 | 0 | 42.2 | Normal |
| C5 | 100 | 0 | 0 | 34.1 | Normal |

Comparison Between Example 10 and C6

Example 10 is test liquid cleaning composition described in Table 5.

Comparative example C6 is a carbon deposit cleaner which was prepared in Example 3 of U.S. Pat. No. 5,407,453A1 using the ingredients described in Table 8.

TABLE 8

| Ingredient | Content/ % wt |
|---|---|
| Polyisobutenyl aminoethylethanolamine(24.4% in a diluent oil) | 6.11 |
| Butyl Cellosolve | 3.00 |
| Methyl Isobutyl Carbinol | 3.00 |
| 500 SUS Neutral Oil | 1.50 |
| 700 SUS Neutral Oil | 0.94 |
| Aqueous Ammonia(28%) | 0.74 |
| Water | 12.23 |
| Oleic Acid | 3.00 |
| Calcium Petroleum Sulfonate | 0.24 |
| Xylene | 10.89 |

TABLE 8-continued

| Ingredient | Content/ % wt |
|---|---|
| Mineral Spirits | 8.59 |
| Gasoline | 49.76 |

Each of these compositions was tested using the AP Cleaning Test Method. The data are presented in Table 9.

TABLE 9

| Example | A | B | C | Cleaning Rate/% | Cleaning class |
|---|---|---|---|---|---|
| 10 | 35 | 35 | 30 | 92.3 | Very Good |
| C6 | | | | 34.2 | Normal |

Example 21

150 g lactic acid and 200 g DI water were introduced into a reactor. Next, 150 g monoethanolamine was introduced into the reactor slowly and then was agitated for 120 min to form a transparent and stable liquid mixture. After that, 60 g AEO7 surfactant, 120 g dodecyl benzenesulfonic acid, 100 g Propylene Glycol Monomethyl Ether, 20 g alkyl dimethyl hydroxy ethyl ammonium chloride, 100 g D60 solvent, and 100 g polyether amine were added into the mixture. The mixture was agitated for 30 min to form a transparent and stable liquid as a liquid cleaning composition.

The ingredients useful for preparing the composition of the example 21 are described as follows:

Part A: surfactant mixture. The composition of the surfactant mixture is shown in Table 10.

TABLE 10

| Ingredient | Content/% |
|---|---|
| LASH | 40 |
| DMP | 33.3 |
| AEO7 | 20 |
| HY | 6.7 |

Part B: solvent mixture. The composition of the solvent mixture is shown in Table 11.

TABLE 11

| Ingredient | Content/% |
|---|---|
| D 60 | 50 |
| 9543 | 50 |

Part C: Alkanol amine hydroxy carboxylate. The composition of alkanol amine hydroxy carboxylate formed by mixing lactic acid with MEA is shown in Table 12.

TABLE 12

| Ingredient | Content/% |
|---|---|
| LA | 50 |
| MEA | 50 |

The cleaning composition of Example 21 was tested using the AP Dipping Cleaning Test Method. The data are presented in Table 13.

TABLE 13

| Example | A | B | C | DI Water | Cleaning Rate/% | Cleaning class |
|---|---|---|---|---|---|---|
| 21 | 30 | 20 | 30 | 20 | 90.2 | Very Good |

It is to be understood that the above description is intended to be illustrative and not restrictive. Various modifications and alterations of this invention will become apparent to those skilled in the art from the foregoing description without departing from the scope and the spirit of this invention, and it should be understood that this invention is not to be unduly limited to the illustrative embodiments set forth herein.

What is claimed is:

1. A method of cleaning an engine having at least one combustion chamber, comprising:

(a) providing a composition comprising:

(i) 10-90 wt % of an alkanol amine hydroxy carboxylate represented by formula (I):

$$RCHOHCOONH_{a+1}((CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 10-90 wt % of a surfactant;

(iii) 0-80 wt % of a solvent; and (iv) 0-80 wt % of water;

(b) introducing the composition into the combustion chamber;

wherein the surfactant is selected from the group consisting of benzenesulfonic acid, a fatty alcohol ethoxylated, propylene glycol monomethyl ether, and alkyl dimethyl hydroxy ethyl ammonium chloride.

2. The method of claim 1, wherein the alkanol amine hydroxy carboxylate is formed by reacting hydroxy acid with alkanol amine.

3. The method of claim 2, wherein the alkanol amine is a compound of formula (II):

$$H_aN((CH_2)_nOH)_b \quad (II)$$

wherein n is an integer in the range of 1 to 10; a is 0, 1 or 2; b is 1, 2 or 3; such that a+b=3.

4. The method of claim 1, wherein the alkyl has one to eight carbon atoms.

5. The method of claim 1, wherein the solvent is an alkyl hydrocarbon.

6. The method of claim 1, wherein the surfactant constitutes 30-70 wt % of the composition.

7. The method of claim 1, wherein the solvent constitutes 30-70 wt % of the composition.

8. The method of claim 1, wherein the composition comprises:

30-70 wt % of the alkanol amine hydroxy carboxylate;

10-60 wt % of the surfactant;

10-60 wt % of the solvent; and 0-50 wt % of water.

9. A method of cleaning an engine having at least one combustion chamber, comprising:

(a) providing a composition comprising:

(i) 10-70 wt % of an alkanol amine hydroxy carboxylate represented by formula (I):

$$RCHOHCOONH_{a+1}((CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 30-70 wt % of a surfactant;

(iii) 0-60 wt % of a solvent; and (iv) 0-60 wt % of water;

(b) introducing the composition into the combustion chamber.

10. The method of claim 9, wherein the alkanol amine hydroxy carboxylate is formed by reacting hydroxy acid with alkanol amine.

11. The method of claim 10, wherein the alkanol amine is a compound of formula (II):

$$H_{a1}N((CH_2)_nOH)_b \quad (II)$$

wherein n is an integer in the range of 1 to 10; a is 0, 1 or 2; b is 1, 2 or 3; such that a+b=3.

12. The method of claim 9, wherein the alkyl has one to eight carbon atoms.

13. The method of claim 9, wherein the surfactant is selected from the group consisting of benzenesulfonic acid, a fatty alcohol ethoxylated, propylene glycol monomethyl ether, and alkyl dimethyl hydroxy ethyl ammonium chloride.

14. The method of claim 9, wherein the solvent is an alkyl hydrocarbon.

15. The method of claim 9, wherein the solvent constitutes 30-60 wt % of the composition.

16. The method of claim 9, wherein the composition comprises:

30-70 wt % of the alkanol amine hydroxy carboxylate;

10-60 wt % of the solvent; and 0-60 wt % of water.

17. A method of cleaning an engine having at least one combustion chamber, comprising:

(a) providing a composition comprising:

(i) 10-60 wt % of an alkanol amine hydroxy carboxylate represented by formula (I):

$$RCHOHCOONH_{a+1}((CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 10-60 wt % of a surfactant;

(iii) 30-70 wt % of a solvent; and (iv) 0-50 wt % of water;

(b) introducing the composition into the combustion chamber.

18. The method of claim 17, wherein the alkanol amine hydroxy carboxylate is formed by reacting hydroxy acid with alkanol amine.

19. The method of claim 18, wherein the alkanol amine is a compound of formula (II):

$$H_aN((CH_2)_nOH)_b \quad (II)$$

wherein n is an integer in the range of 1 to 10; a is 0, 1 or 2; b is 1, 2 or 3; such that a+b=3.

20. The method of claim 17, wherein the alkyl has one to eight carbon atoms.

21. The method of claim 17, wherein the surfactant is selected from the group consisting of benzenesulfonic acid, a fatty alcohol ethoxylated, propylene glycol monomethyl ether, and alkyl dimethyl hydroxy ethyl ammonium chloride.

22. The method of claim 17, wherein the solvent is an alkyl hydrocarbon.

23. The method of claim 17, wherein the surfactant constitutes 30-60 wt % of the composition.

24. The method of claim 17, wherein the composition comprises:

30-60 wt % of the alkanol amine hydroxy carboxylate;

10-60 wt % of the surfactant; and 0-50 wt % of water.

25. A method of cleaning an engine having at least one combustion chamber, comprising:

(a) providing a composition comprising:

(i) 30-70 wt % of an alkanol amine hydroxy carboxylate represented by formula (I):

$$RCHOHCOONH_{a+1}((CH2)_nOH)_b \quad (I)$$

wherein n is an integer in the range of 1 to 10; a is 0, 1 or 2; b is 1, 2 or 3; such that a+b=3; R represents hydrogen atom or alkyl;

(ii) 10-60 wt % of a surfactant;

(iii) 10-60 wt % of a solvent; and (iv) 0-50 wt % of water;

(b) introducing the composition into the combustion chamber.

26. The method of claim 25, wherein the alkanol amine hydroxy carboxylate is formed by reacting hydroxy acid with alkanol amine.

27. The method of claim 26, wherein the alkanol amine is a compound of formula (II):

$$H_aN((CH_2)_nOH)_b \quad (II)$$

wherein n is an integer in the range of 1 to 10; a is 0, 1 or 2; b is 1, 2 or 3; such that a+b=3.

28. The method of claim 25, wherein the alkyl has one to eight carbon atoms.

29. The method of claim 25, wherein the surfactant is selected from the group consisting of benzenesulfonic acid, a fatty alcohol ethoxylated, propylene glycol monomethyl ether, and alkyl dimethyl hydroxy ethyl ammonium chloride.

30. The method of claim 25, wherein the solvent is an alkyl hydrocarbon.

* * * * *

UNITED STATES PATENT AND TRADEMARK OFFICE

CERTIFICATE OF CORRECTION

PATENT NO. : 8,809,248 B2
APPLICATION NO. : 13/321958
DATED : August 19, 2014
INVENTOR(S) : Xin Huo It is certified that error appears in the above-identified patent and that said Letters Patent is hereby corrected as shown below:

IN THE SPECIFICATION:

Col. 1, line 46, delete "polyisobuteny" and insert -- polyisobutenyl --

Col. 4, line 36, delete "polyoxylakylene" and insert -- polyoxyalkylene --

Col. 4, line 67, delete "(Pragpagen HY)." and insert -- (Praepagen HY). --

Col. 6, line 43, delete "Clairiant" and insert -- Clariant --

Col. 8, line 25, delete "3" and insert -- 3. --

Col. 8, line 34, delete "4" and insert -- 4. --

Col. 11, line 32, delete "B" and insert -- B. --

Col. 11, line 35, delete "7" and insert -- 7. --

IN THE CLAIMS:

Col. 14, line 26, In Claim 11, delete "$H_{a1}N((CH_2)_nOH)_b$" and insert -- $H_aN((CH_2)_nOH)_b$ --

Signed and Sealed this
Sixth Day of January, 2015

Michelle K. Lee

Michelle K. Lee
*Deputy Director of the United States Patent and Trademark Office*